US008127649B2

(12) United States Patent
Holliday

(10) Patent No.: US 8,127,649 B2
(45) Date of Patent: Mar. 6, 2012

(54) PAPER PUSHING DEVICE

(75) Inventor: Brightman Kenneth Holliday, Conyers, GA (US)

(73) Assignee: Atlas Die LLC, Elkhart, IN (US)

( * ) Notice: Subject to any disclaimer, the term of this patent is extended or adjusted under 35 U.S.C. 154(b) by 311 days.

(21) Appl. No.: 12/426,699

(22) Filed: Apr. 20, 2009

(65) Prior Publication Data

US 2010/0263506 A1 Oct. 21, 2010

(51) Int. Cl.
*B26D 7/06* (2006.01)

(52) U.S. Cl. ..... 83/109; 83/123; 83/128; 83/167

(58) Field of Classification Search ..... 83/651–858, 83/167, 911, 128, 109, 123; 30/361, 358
See application file for complete search history.

(56) References Cited

U.S. PATENT DOCUMENTS

| | | | | | |
|---|---|---|---|---|---|
| 2,679,291 | A | * | 5/1954 | Collinson | 83/284 |
| 3,345,896 | A | * | 10/1967 | Bennett | 83/128 |
| 3,946,627 | A | * | 3/1976 | Hofmann | 83/117 |
| 4,462,288 | A | * | 7/1984 | Boyce | 83/128 |
| 4,850,950 | A | | 7/1989 | Holliday | |
| 4,896,573 | A | * | 1/1990 | Kapolnek | 83/117 |
| 5,029,505 | A | | 7/1991 | Holliday | |
| 5,140,872 | A | | 8/1992 | Holliday et al. | |
| 5,197,367 | A | | 3/1993 | Holliday | |
| 5,211,084 | A | | 5/1993 | Holliday et al. | |
| 5,333,519 | A | | 8/1994 | Holliday et al. | |
| 5,546,839 | A | * | 8/1996 | Gardiner | 83/128 |
| 5,582,102 | A | | 12/1996 | Holliday | |
| RE35,522 | E | | 6/1997 | Holliday | |
| 5,730,039 | A | | 3/1998 | Holliday et al. | |
| 6,644,153 | B1 | * | 11/2003 | Gordon | 83/27 |
| 6,659,927 | B2 | | 12/2003 | Myers et al. | |
| 6,692,425 | B2 | | 2/2004 | Myers et al. | |
| 6,779,426 | B1 | | 8/2004 | Holliday | |
| 6,792,840 | B2 | | 9/2004 | Myers et al. | |
| 6,966,245 | B1 | * | 11/2005 | Simpson | 83/27 |
| 7,360,475 | B2 | * | 4/2008 | Quercia | 83/111 |

* cited by examiner

*Primary Examiner* — Boyer D Ashley
*Assistant Examiner* — Omar Flores Sanchez
(74) *Attorney, Agent, or Firm* — Kilyk & Bowersox, P.L.L.C.

(57) ABSTRACT

According to various embodiments, the present teachings relate to a paper pushing device. The paper pushing device can comprise a shaft configured to be received and anchored in an opening of a retaining board. The paper pushing device can comprise a head connected to the shaft. The paper pushing device can comprise an arm that extends from the head at an angle relative to a longitudinal axis of the shaft. The paper pushing device can be used in various tool and die, stock manipulating operations.

16 Claims, 6 Drawing Sheets

PAPER PUSHING DEVICE

FIELD

The present teachings relate to the field of paperboard processing, and more particularly to a device, system, and method for pushing paperboard, or other sheet-like stock out of a press, die, punch, stripping station, blanking station, or other paperboard manipulating apparatus.

BACKGROUND

Packaging, stationary, and other paper-based products are generally manufactured using sheets of paperboard or other raw paper stock that is drawn across a press, die, punch, stripping station, blanking station, or other paperboard manipulating equipment. Cartons, containers, playing cards, signs, placards, corrugated boxes, and other paperboard products are generally formed by contacting the stock with a punch or die. The methods can comprise contacting the stock with a cutting or creasing blade to generate blanks out of the sheet.

A first process of stripping out holes or sections from a larger piece of stock is generally referred to as stripping. Stripping leaves a shaped hole and a desired perimeter or outline in the otherwise intact stock paperboard. Subsequently, a second process of cutting or punching a desired shape or section of the stock entirely out of the stock, dropping, and collecting the removed portion, is generally referred to as blanking. In both stripping and blanking operations, the paperboard, cardboard, plastic, fibrous, or other material, is conveyed over a working area. The working area can generally include a flat cutting surface or a hollow female blanking area over which a blank piece of stock can be contacted with a blade, punch, or other working tool. The paperboard or stock is conveyed through such work stations on support frames, for example, on wooden, metal, paddled, or other support frames, which can be sized to conform to the size of the blank stock. The sheets can be conveyed across the stripping or blanking stations using conveyor belts, belt drives, linear motors, or other sources of mechanical driving force.

Known stripping and blanking configurations suffer from a number of drawbacks. During a stripping operation, a paperboard stock is cut and/or creased into a desired form. The cut stock can be perforated such that the desired product remains attached to the surrounding paperboard skeleton. During a stripping operation, the paperboard stock can become stuck or lodged in the die as the die is retracted from the work station. Also, during a stripping operation, the surrounding paperboard skeleton can become stuck in the stripper.

Similarly, during blanking operations, a blanking press can cause pressure on a paperboard stock such that a desired product can be removed from the surrounding paperboard skeleton. When the blanking press is retracted from the work station, a vacuum can be created between the blanking press and the product blank, thereby causing the paperboard skeleton product to become stuck in the blanking unit. Resulting jams and hang-ups in the material supply path and incomplete or faulty stripping and/or blanking operations can require valuable operator time and effort to fix. These errors can also cause lost costs due to manufacturing downtime, and can result in a loss of potentially recoverable material. A need exists to eliminate these and other drawbacks in the art.

SUMMARY

In some embodiments, the present teachings relate to a paper pushing device. The paper pushing device can comprise a shaft configured to be received in an opening of a retaining board. The shaft can comprise a longitudinal axis, a distal end, a support end opposite the distal end, and a paddle connected to the distal end.

According to various embodiments, the paper pushing device can comprise a head having a planar top surface. The head can comprise a bottom surface that can intersect with the support end of the shaft, at an intersection. The head can comprise a shoulder that begins at the intersection and extends outwardly away from the shaft. The shoulder can provide the head with a bottom contact surface which, when rested in an opening of a retaining board, can prevent the head from moving into the opening.

According to various embodiments, the paper pushing device can comprise an arm extending from the head and away from the longitudinal axis of the device shaft. The arm can comprise an intermediate section connected to the head, and a diverging section. The diverging section can have a narrow end and a wide end. The arm can comprise a paddle connected to the wide end of the diverging section. The narrow end of the diverging section can be connected to the intermediate section. In some embodiments, the intermediate section can comprise a first width. The paddle can comprise a second width that is greater than the width of the narrow end of the diverging section. The diverging section can comprise a width that increases from the first width to the second width. In some embodiments, the intermediate section can extend from the head at an angle of from about 110° to about 160° relative to the longitudinal axis of the shaft. The paddle can be angled with respect to the intermediate section at an angle of from about 115° to about 165°, relative to the intermediate section. The paddle can comprise a top contact surface. The top contact surface can comprise a planar surface. In some embodiments, the planar surface of the top contact surface can be substantially parallel to the planar top surface of the head.

According to various embodiments, the paper pushing device can comprise a shaft, and the shaft can comprise a collar that extends around the shaft and intersects with the bottom contact surface of the head. The shaft can comprise a minimum diameter. The collar can comprise an outer diameter that is greater than the minimum diameter. The shaft can comprise one or more annular sections. In some embodiments, the shaft can comprise a plurality of annular sections, wherein the annular sections are spaced apart from one another. Each annular section can extend radially outwardly from the shaft and can comprise an outer diameter that is greater than the minimum diameter of the shaft. In some embodiments, the outer diameter of each annular section can be greater than the outer diameter of the collar.

In some embodiments, the present teachings relate to a system comprising a paper pushing device and a retaining board that can comprise an operational surface. The retaining board can comprise an opening disposed in the operational surface, for example, a hole, a recess, a well, a through hole, or the like. The shaft of the paper pushing device can be disposed in the opening, for example, to anchor the device in the retaining board. The retaining board can comprise a thickness, and in some embodiments the opening can comprise at least one through hole that extends all the way through the thickness of the retaining board. In some embodiments, the opening can comprise a hole that does not extend all the way through the retaining board such that the opening comprises a bottom. The opening can have a diameter that matches the outer diameter of the annular sections of the shaft, or that is just slightly larger than the outer diameter of the shaft such that the shaft snugly fits within the opening.

According to various embodiments, the retaining board can comprise one or more die rule slots disposed in the operational surface. The die rule slots can be configured to receive a die rule. The retaining board can comprise one or more die lock retaining slots disposed in the operational surface. The die lock retaining slots can intersect with one or more die rule slots. The die lock retaining slots can be configured to receive a die lock.

In some embodiments, the retaining board can comprise at least one die rule disposed in the one or more die rule slots. The die rule can comprise a distal edge spaced away from the retaining board such that the distal edge is disposed a first distance from the operational surface. The retaining board can comprise at least one die lock disposed in the one or more die lock retaining slots. One or more die locks disposed in one or more respective die lock retaining slots can be used to lock one or more die rules in the one or more die rule retaining slots. For example, die rules, die locks, retaining boards, adjustment systems, and methods that can be used according to various embodiments include those shown and described in U.S. Pat. Nos.: 6,779,426; 5,730,039; RE 35,522; 5,582,102; 5,333,519; 5,211,084; 5,197,367; 5,140,872; 5,029,505; and 4,850,950; each of which is incorporated herein in its entirety by reference. The retaining board can comprise at least one compressible stabilizing cushion connected to the operational surface. The compressible stabilizing cushion can extends away from the operational surface of the retaining board and comprise a contact surface. The contact surface of the compressible stabilizing cushion can be spaced away from the operational surface by a second distance, and in some embodiments the second distance can be greater than the first distance. In some embodiments, the contact surface of the paper pushing device can be spaced away from the operational surface by a third distance that can be greater than the first distance, greater than the second distance, or greater than both the first and second distances.

In some embodiments, the present teachings relate to a method of processing a workpiece. The method can comprise manipulating a workpiece in at least one station. The at least one station can comprise a stripping station, a blanking station, an embossing station, a printing station, or the like. The station can be used to form a manipulated workpiece, for example, a paperboard blank. The method can comprise expelling the workpiece from the at least one station by using a paper pushing device according to the present teachings. The paper pushing device can comprise a shaft configured to be received in the opening of a retaining board and the paper pushing device can comprise a head connected to the shaft. The paper pushing device can comprise an arm extending from the head. The arm can comprise an intermediate section connected to the head, a paddle, and a diverging section having a narrow end and a wide end. The narrow end can be connected to the intermediate section and the wide end can be connected to the paddle. The workpiece can comprise any type of material that can be manipulated by a stripping station, a blanking station, an embossing station, a printing station or the like, for example, the workpiece can comprise a paperboard stock.

These and other embodiments of the present teachings will be more fully understood with reference to the drawings appended hereto and the detailed description set forth below. The specific embodiments described herein are exemplary only and are not to be construed as limiting. Various modifications, substitutions, deletions, and other changes can be made, as would be understood by those skilled in the art, without departing from the present teachings.

DRAWINGS

The present teachings will be described with reference to the accompanying drawings, in which like elements are referenced with like numbers.

Figure 1:
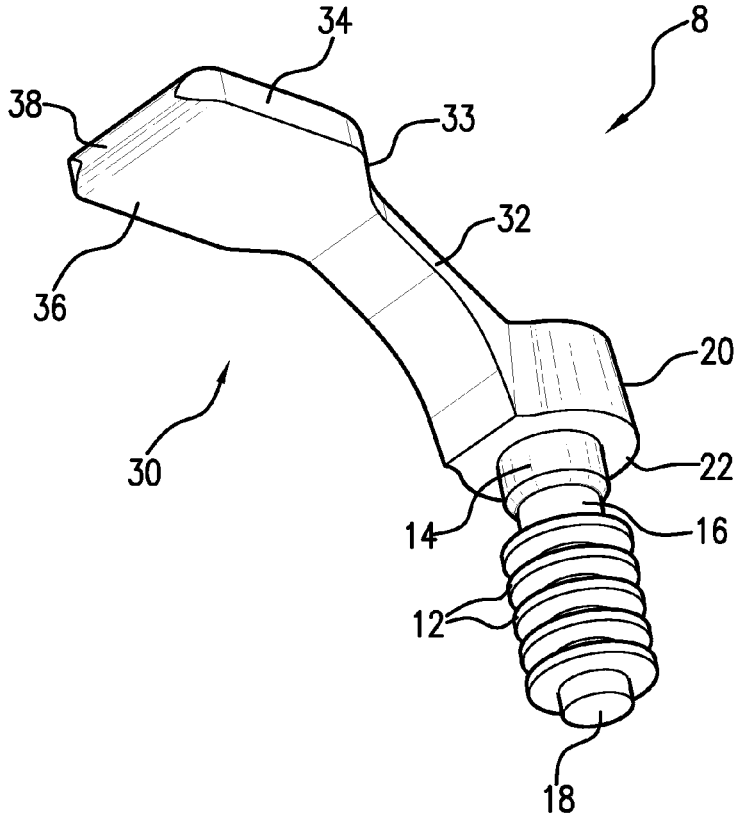
FIG. 1 is a bottom perspective view of a paper pushing device according to various embodiments of the present teachings.
Figure 7:
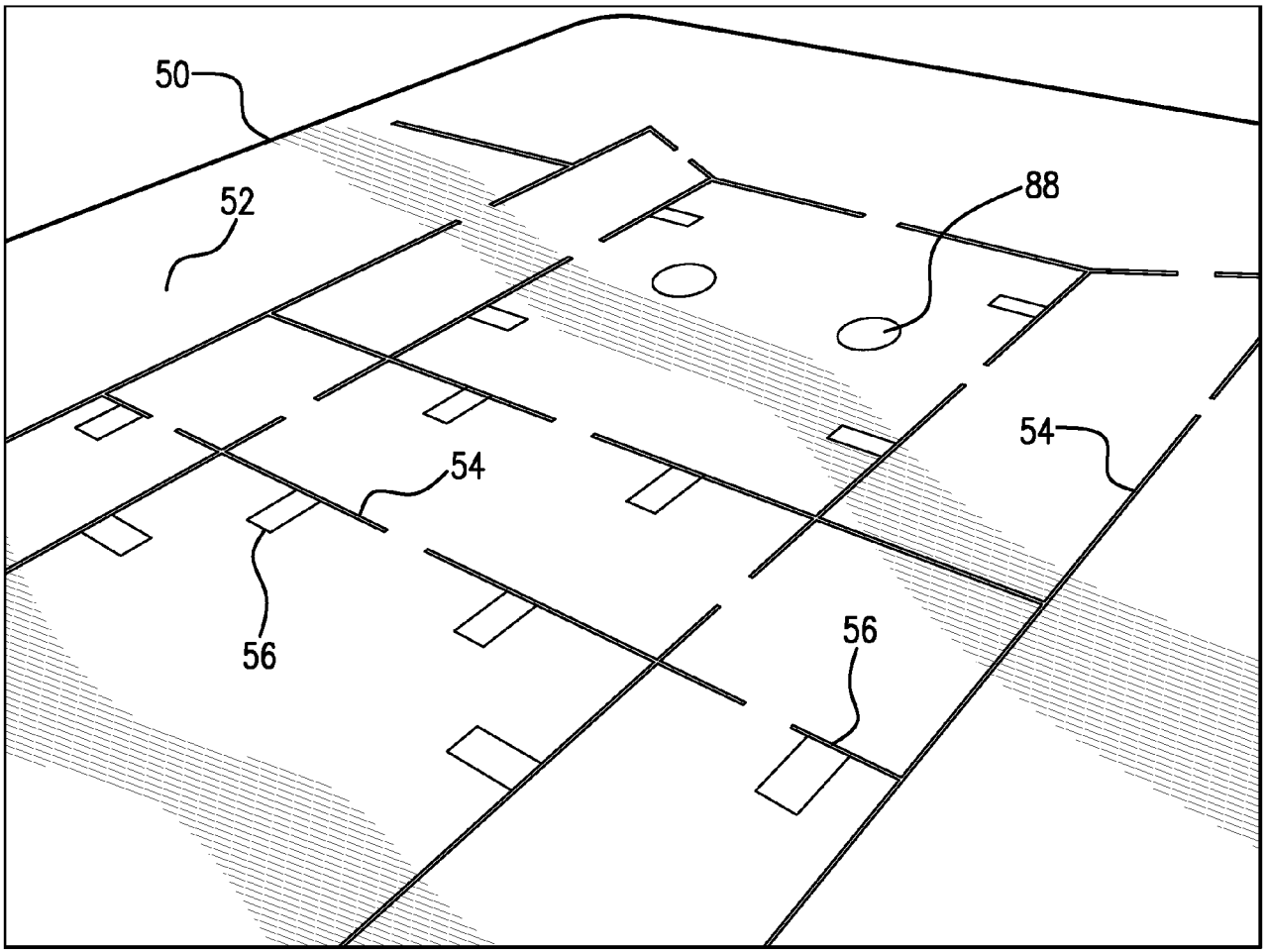
FIG. 7 illustrates a perspective top view of an operational surface of a retaining board, according to various embodiments.
Figure 8:
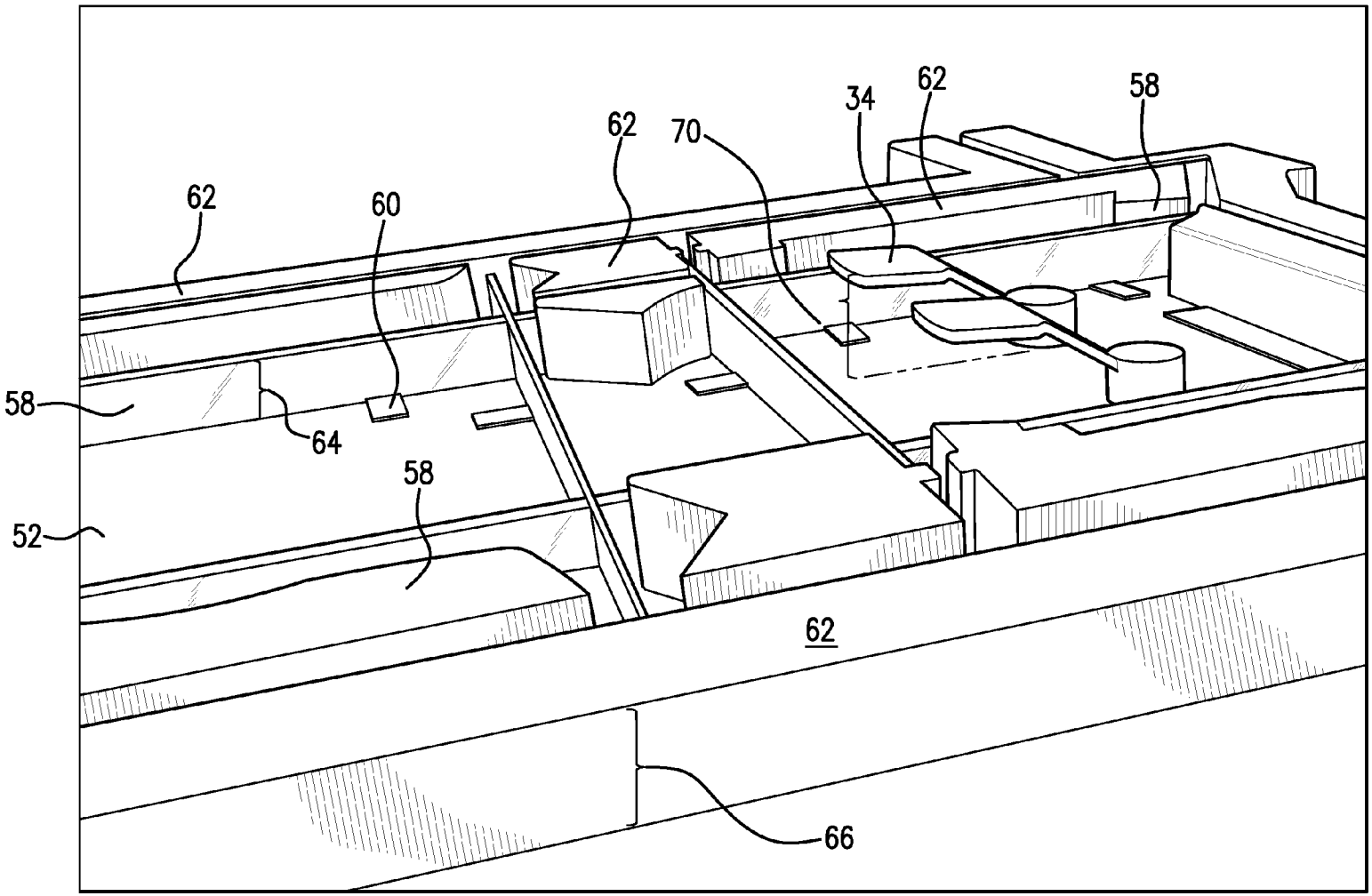
Figure 9:
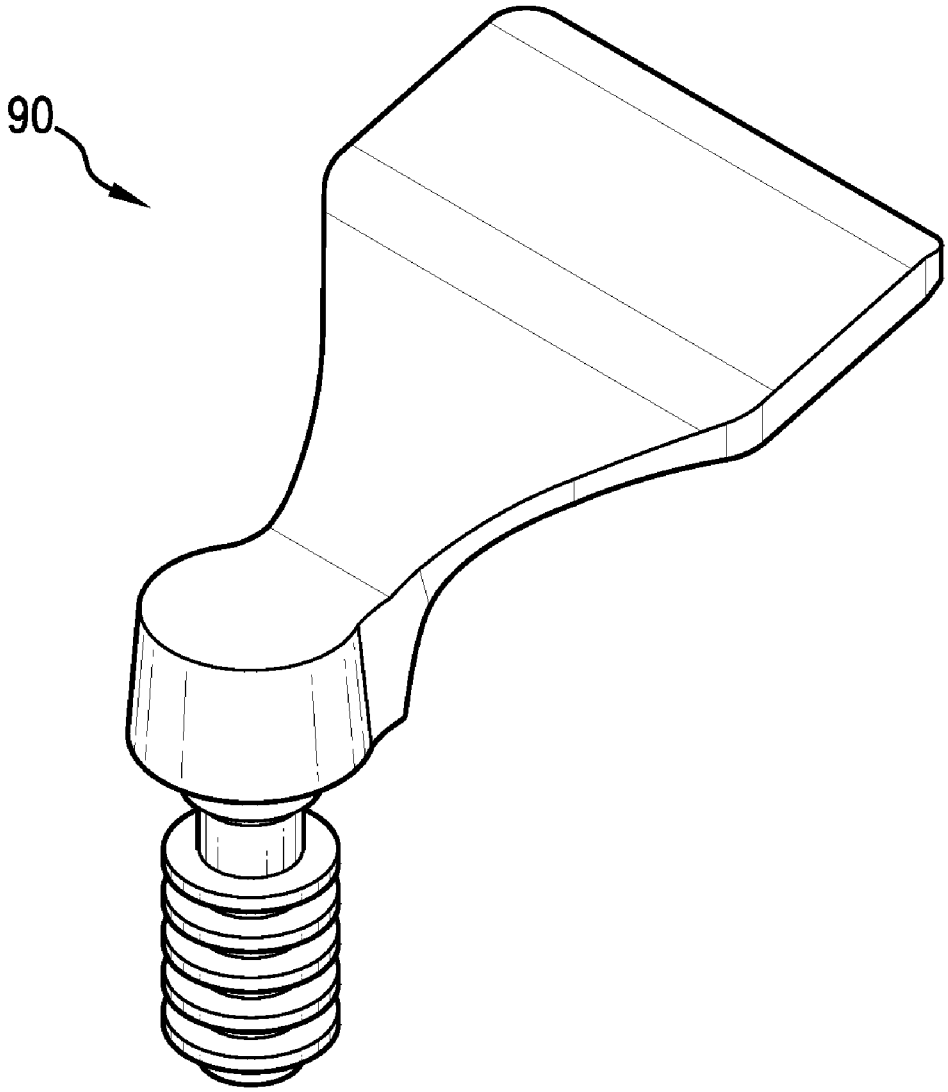

FIG. 8 is a top view of the operational surface of FIG. 7 with two paper pushing devices of FIG. 1 disposed therein, a plurality of compressible stabilizing cushions attached thereto, and a plurality of die rules disposed therein, according to various embodiments of the present teachings; and FIG. 9 is a top perspective view of a paper pushing device according to yet another embodiment of the present teachings.

DETAILED DESCRIPTION

According to various embodiments of the present teachings, a paper pushing device can be configured to contact paperboard or other stock, for example, that comprises fibrous material, paper, plastic, film, a web, cardboard, or any other product capable of being manipulated by a die cutting press. The paper pushing device can comprise a shaft that can be configured to be received and anchored in an opening in a retaining board. The shaft can have a longitudinal axis. The paper pushing device can comprise a head connected to the shaft. The paper pushing device can comprise an arm that extends from the head at an angle relative to the longitudinal axis. The arm can comprise an intermediate section. The arm can comprise a paddle and the paddle can comprise a contact surface. The paddle can be connected to the distal end of the arm. The intermediate section can have a first width and the paddle can have a second width that is larger than the first width. The arm can further comprise a diverging section that connects the paddle and the intermediate section. As will be appreciated, the paddle does not have to be disposed at the distal end of the arm. In some embodiments, the arm itself can comprise a paddle.

According to various embodiments, the paper pushing device can be used in combination with a retaining board to form a system or station. The station can be, for example, a blanking station, a stripping station, an embossing station, a printing station, a creasing station, a bending station, a shaving station, a trimming station, and/or any other station used in the tool and die industry.

According to various embodiments, a workpiece such as a piece of paperboard stock can be manipulated by a work station. As referred to herein, a workpiece can comprise one or more sheets of paper, paperboard material, web, film, net, fibrous material, or the like, that can be manipulated by the work station. As the workpiece is manipulated by the work station, the paper pushing device of the present teachings can be used to prevent problems such as catching, snagging, and lodging of the stock, blank, skeleton, and/or waste.

According to various embodiments, the paper pushing device of the present teachings can comprise an elastic material such that when a pressure is applied to the paper pushing device, the device can be configured to be elastically deformed. When the pressure is removed, the device can elastically rebound to its original position. An example of materials that can be used to form the paper pushing device can include, but are not limited to, polymeric materials, polyethylene (PE), polyurethane (PU), polypropylene (PP), polyoxymethylene (POM), polytetrafluoroethylene (PTFE), other plastic materials, stainless steel, titanium, a combination thereof, and/or any other suitable material for providing elasticity. The paper pushing device can comprise acetal resin, for example, DELRIN® acetal resin, available E.I. du Pont de Nemours and Company, Wilmington, Del.

In some embodiments, the paper pushing device can be configured such that when a force is applied to the contact surface of the device, the arm can compress due to the force. The paper pushing device can be configured , however, to elastically rebound in response to retraction of the applied force. The elasticity of the paper pushing device can allow for the arm to return, rebound, and/or recoil to an original position. In some embodiments, the contact surface of the paper pushing device can contact a workpiece, and become compressed. The paper pushing device can be configured to elastically rebound so as to apply sufficient pressure to a resulting manipulated workpiece to push the workpiece out of the station and/or clear it from die rules or other manipulating devices in the station. The paper pushing device can be configured to push a workpiece and thereby separate the workpiece, from surrounding scrap. For example, the paper pushing device can be configured to push a work product out of a manipulating station and away from scrap material.

According to various embodiments, the head of the paper pushing device can comprise a shoulder. The shaft can comprise a first diameter. The shoulder can have a second diameter that is wider than the first diameter of the shaft. The retaining board can comprise an operational surface. The operational surface can comprise an opening for receiving the paper pushing device. The opening in the retaining board can be wide enough to allow the shaft to be inserted but snugly fit therein. The opening of the retaining board can be narrow enough so as to prevent the shoulder of the head from being inserted into the opening. In some embodiments, the retaining board can comprise a plurality of openings, each for receiving a respective paper pushing device. Each opening can extend all the way through the retaining board, but in some embodiments, the opening does not extend all the way through the board and instead has a bottom surface. In some embodiments, the end of the shaft can be configured to contact the bottom surface of the opening.

According to various embodiments, the operational surface of the retaining board can comprise one or more openings for receiving any number of tool and/or die components. Each opening can comprise, for example, a slot, a gap, a groove, a recess, a hole, or another type of opening. The openings can be configured so as to receive, hold, anchor, and/or lock in place any number of tool and die components. For example, the retaining board can comprise openings to receive, hold, anchor, and/or lock in place dies, compressible cushioning devices, paper pushing devices, paper lifting devices and/or any other tool and die components. The retaining board can comprise any known board material, for example, metal, wood, plastic, composite, a combination thereof, or the like.

According to various embodiments, the paper pushing device of the present teachings can be configured to push paper away from a die rule that is disposed in a retaining board. In some embodiments, the paper pushing device of the present teachings can be configured to push a workpiece out of a vacuum hold. The paper pushing device can be configured to press against a workpiece such that the workpiece is prevented from getting stuck to components mounted in or on a retaining board. In some embodiments, the paper pushing device can be used in a stripping station or a blanking station. The paper pushing device can be configured to be disposed in an interference area of a male stripper device to prevent scrap material from lifting up after stripping has occurred.

With reference to the drawings and as illustrated in the FIGS., a paper pushing device 8 according to various embodiments can comprise a shaft 16. Shaft 16 can have a first diameter. The diameter of the shaft can be from about 0.01 inch to 3.00 inches, for example, from 0.25 inch to 1.00 inch, or about 0.5 inch. As will be appreciated, the width of the shaft of the paper pusher is not limited to a specific range of values, and cross-sectional shapes other than circular can be used. Shaft 16 can comprise a collar 14. Collar 14 can have a diameter that is greater than the diameter of shaft 16. Shaft 16 can comprise an end 18. Between collar 14 and end 18, the shaft can comprise one or more annular protrusions 12. Each annular protrusion 12 can comprise a diameter that is greater than the diameter of shaft 16. While five annular protrusions are illustrated in the FIGS., it will be appreciated that shaft 16 can comprise any number of annular protrusions, for example, 1, 4, 7, 10, or any other number of protrusions. In some embodiments, shaft 16 does not comprise any annular protrusions. In some embodiments, shaft 16 does not comprise a collar. In some embodiments, the shaft can be of the same diameter from one end of the shaft to the other end. Shaft 16 can comprise a longitudinal axis that runs parallel to shaft 16.

According to various embodiments and as illustrated in the FIGS., paper pushing device 8 can comprise a head 20. Head 20 can be generally circular. In some embodiments, the head can be frusto-conically-shaped. As shown in FIG. 1, head 20 has a truncated conical shape. As will be appreciated, the shape of the head is not limited to a conical shape. The head can have a body that is at least partially spherical, hemispherical, rectangular, cubical, pyramidal, trapezoidal, conical, or any other shape that is desired. Head 20 can be connected to shaft 16. At the point of connection, head 20 can comprise a shoulder 22. Shoulder 22 can comprise a diameter that is greater than the diameter of collar 14 and is greater than the diameter of shaft 16.

According to various embodiments, an arm 30 can extend off of head 20. Arm 30 can extend at an angle relative to the longitudinal axis of shaft 16. Arm 30 can extend at an angle that is in a range of from 91° to 170°, from 110° to 160°, from 120° to 150°, or from 130° to 140°. According to various embodiments, the exact angle at which the arm extends from the head, with respect to the longitudinal axis of the shaft, is not necessarily limited to a specific range of values. Arm 30 can comprise an intermediate section 32, a divergent section 33, and a paddle 34. A first end of intermediate section 32 can connect to head 20, and a second end of intermediate section 32 can connect to divergent section 33. In some embodiments, the first end of intermediate section 32 can have a thickness that is greater than the thickness of the second end of intermediate section 32. As will be appreciated, the arm 30 does not need to comprise each of these parts. In some embodiments, one or more of the above mentioned parts for arm 30 can be removed, replaced or combined.

In some embodiments, and as shown in FIGS., the thickness of the first end of intermediate section 32 at the connection to head 20, is greater than the thickness of intermediate section 32 at the connection to divergent section 33. As will be appreciated, the thickness of intermediate section 32 is not limited to this particular embodiment. In some embodiments, the thickness of intermediate section 32 can be equal throughout. In some embodiments, the thickness of the head end of intermediate section 32 can comprise a smaller thickness than the thickness of the divergent section end of the intermediate section. As shown in the FIGS., the width of intermediate section 32 can remain the same, however, intermediate section 32 is not limited to this design. Intermediate section 32 can instead be designed according to various embodiments to have a first width that is narrower at the first end, and a second width such that it is wider at the second end, or vice versa. Intermediate section 32 can have a length that extends from the first end to the second end, and the length can be from 0.1 inch to 4.0 inches, for example, from 0.25 inch to 2.0 inches, or about 0.5 inch or about 0.75 inch. The thickness, length, and width of intermediate section 32 are not limited to these specific dimensions.

According to various embodiments, arm 30 can comprise a paddle 34. Paddle 34 can be angled with respect to intermediate section 32, at an angle of from 90° to 180°, from 100° to 160°, from 115° to 165°, or from 135° to 145°. In some embodiments, the paddle is arranged on a plane that is angled in a range from 90° to 100° with respect to the longitudinal axis of the shaft. Paddle 34 can comprise a width of from about 0.1 inch to 3.0 inches, for example, from 0.25 inch to 1.5 inches, about 0.5 inch, about 0.75 inch, about 1 inch, or about 1.5 inches.

Figure 3:
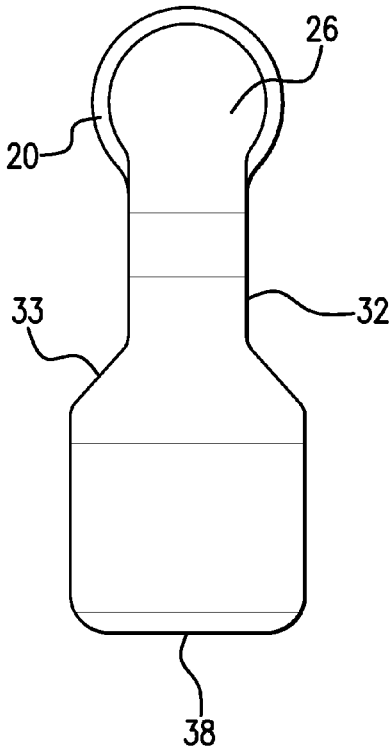
FIG. 3 is a top view of the paper pushing device shown in FIG. 1.

In some embodiments, paddle 34 can comprise an underside 36. Paddle 34 can comprise a distal end 38. As shown in FIG. 3, the paddle is generally square shaped, however, it will be appreciated that the shape of the paddle is not limited to this design. In some embodiments, the paddle can be rectangular, circular, trapezoidal, triangular, or of any other shape desired. Paddle 34 can comprise a second width that can be greater than the width of intermediate section 32. In some embodiments, arm 30 can comprise a divergent section comprising a wide end and a narrow end, wherein the wide end is wider than the narrow end. As shown, the wide end of divergent section 33 can connect to paddle 34, and the narrow end of divergent section 33 can connect to intermediate section 32.

Figure 2:
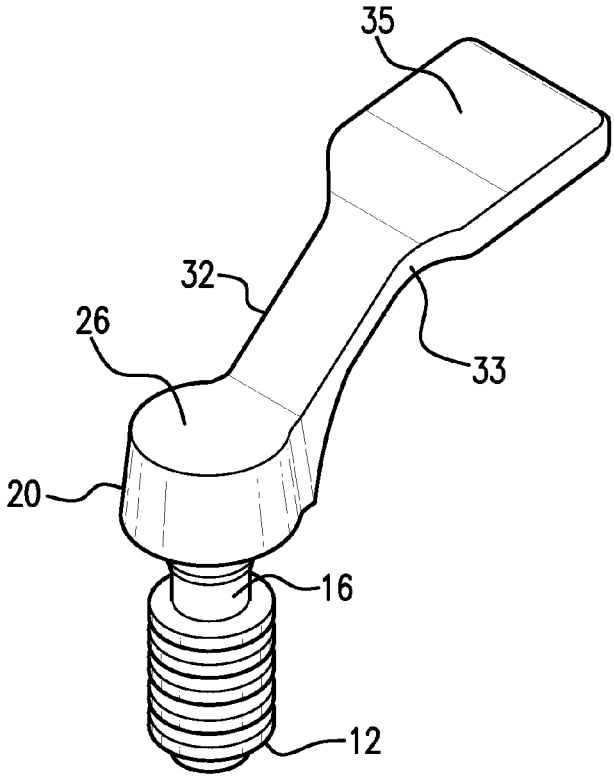
FIG. 2 is a top perspective view of the paper pushing device shown in FIG. 1.

According to various embodiments and as illustrated in FIG. 2, paddle 34 can comprise a contact surface 35. Contact surface 35 can be configured to contact a workpiece. In some embodiments, contact surface 35 can be generally planar. Contact surface 35 is not limited to a planar design, and can be of any shape desired. In some embodiments, head 20 can comprise a top surface 26 that can be relatively planar and parallel to contact surface 35. Top surface 26 can extend perpendicularly relative to the longitudinal axis of shaft 16.

According to various embodiments and as illustrated in FIG. 3, the paper pushing device can comprise a distal end 38 located at an end of arm 30. Distal end 38 can be disposed at an end of paddle 34. In some embodiments, distal end 38 is not disposed at the end of paddle 34 but can instead extend beyond paddle 34. In some embodiments, paddle 34 can be connected directly to head 20.

Figure 4:
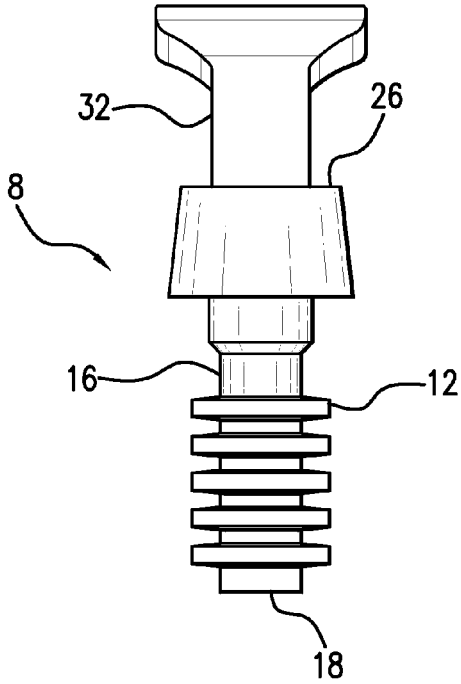
FIG. 4 is front view of the paper pushing device shown in FIG. 1.

According to various embodiments and as illustrated in FIG. 4, paper pushing device 8 can comprise one or more annular protrusions 12 extending away from shaft 16. Each annular protrusion 12 can comprise a diameter that is greater than the minimum diameter of shaft 16. Each annular protrusion 12 can be disposed perpendicularly to the longitudinal axis of shaft 16. In some embodiments, shaft 16 does not comprise any annular protrusions. In some embodiments, the shaft comprises a single diameter that begins at the head and continues to distal end 18 of shaft 16.

Figure 5:
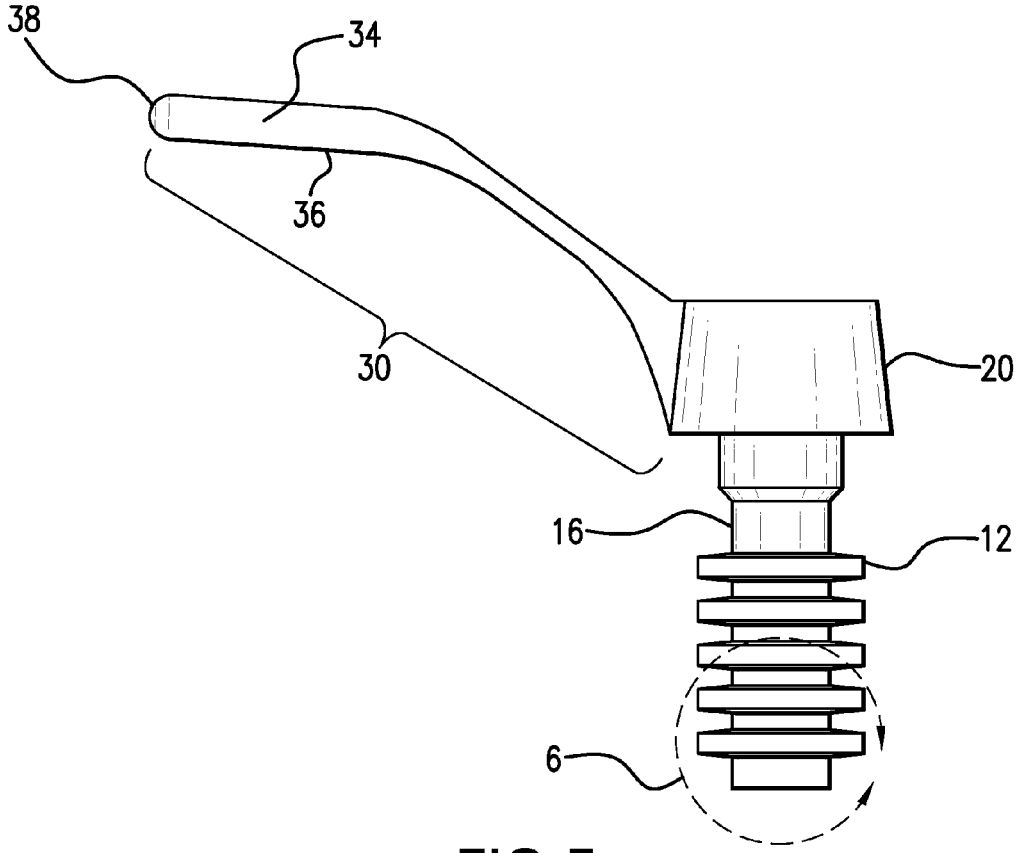
FIG. 5 is a side view of the paper pushing device shown in FIG. 1.

According to various embodiments and as illustrated in FIG. 5, arm 30 can extend away from head 20 at an angle with respect to the longitudinal axis of shaft 16. As shown in FIG. 5, arm 30 extends from head 20 at an angle of approximately 1350 with respect to the longitudinal axis of shaft 16. As will be appreciated, the angle at which arm 30 extends from head 20 is not limited to a specific angle and can be within any of a number of ranges of angles, for example, the angle can be within the range of from 90° to 180°. As shown in FIG. 5, paddle 34 can extend from intermediate section at an angle of about 140° with respect to intermediate section 32. As will be appreciated, the angle with which paddle 34 extends from intermediate section 32 is not limited to a specific angle and can be within any range of angles, for example, the angle can be within the range of from 90° to 180°.

Figure 6:
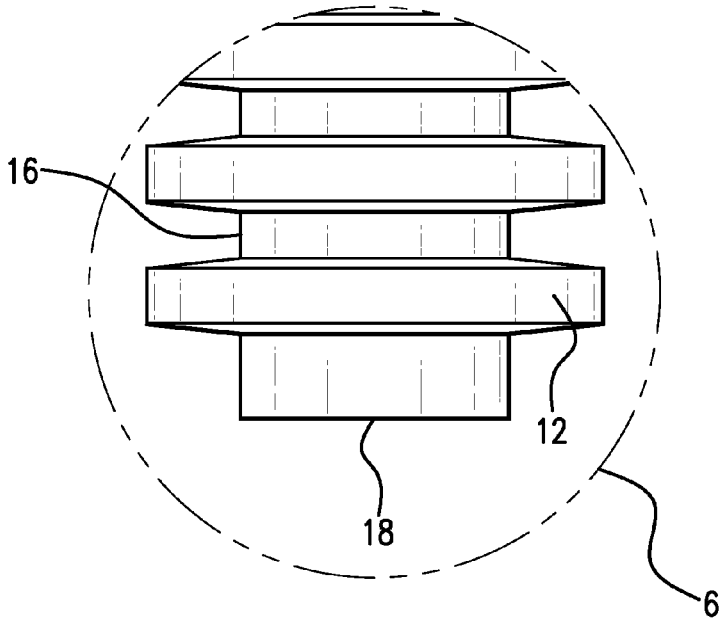
FIG. 6 is a sectional view taken along circular section 6 shown in FIG. 5.

According to various embodiments, FIG. 5 illustrates a circular section 6 that is depicted in an enlarged view in FIG. 6. As shown in FIG. 6, annular protrusions 12 can comprise an upper tapered portion. Annular protrusion 12 can comprise a lower tapered portion that is similar to, for example, a mirror image of the upper tapered portion. In some embodiments, the annular protrusions do not comprise tapered portions.

According to various embodiments, the paper pushing device of the present teachings can be implemented in a system. The system can comprise a retaining board and one or more paper pushing devices mounted in the retaining board. The retaining board can comprise an operational side that can be configured to receive, hold, anchor, secure, and/or lock in place any number of components for use in stripping, blanking, cutting, embossing, printing, or other workpiece manipulation activities. An example of a retaining board is shown in FIG. 7 with reference to numeral 50. Retaining board 50 can comprise an operational surface 52. Operational surface 52 can comprise one or more slots for receiving any number of components, for example, die slot 54, die lock retaining slot 56, paper pusher slot 88, or any other desired openings or slots. Die slot 54 can be configured to receive one or more die rules. Die slot 54 can be configured to lock into place one or more die rules.

According to various embodiments, die lock retaining slot 56 can be configured to receive one or more die locks. Die lock retaining slot 56 can be configured to lock into place one or more die locks. Paper pusher slot 88 can be configured to receive a paper pushing device. Paper pusher slot 88 can be configured to lock in place a paper pushing device. Die slot 54, die lock retaining slot 56, and/or paper pusher slot 88 can comprise any suitable shape and size. In some embodiments, die slot 54 can be in communication with one or more die lock retaining slots 56. Die slot 54, die lock retaining slot 56, and paper pusher slot 88 can be manufactured in any conventional manner, for example, by laser cutting, drilling, stripping, or any other known method.

According to various embodiments, FIG. 8 illustrates a retaining board 50 having disposed therein a plurality of components. The plurality of components are disposed in operational surface 52 of retaining board 50. Retaining board 50 can have disposed therein one or more die rules 58. Each die rule 58 can be used for cutting and/or creasing a workpiece. Each die rule 58 can be configured to contact a workpiece and can comprise a blade like feature. In some embodiments, each die rule 58 can be held in retaining board 50 by one or more respective die slots. Retaining board 50 can have disposed therein, one or more die locks 60. Each die lock 60 can be held in retaining board 50 by a die lock retaining slot. Each die lock 60 can be operatively positioned to contact a respective die rule 58.

In some embodiments, each die rule 58 can extend away from operational surface 52 by a first distance 64. First distance 64 can represent the distance between operational surface 52 of retaining board 50 and the most distal edge of die rule 58. First distance 64 can be any desired distance, for example, in a range of from 0.1 inches to 3 inches, for example, 0.5 inches, 1 inch, 1.5 inches, or other desired distance. As will be appreciated, first distance 64 is not limited to any specific range of distances.

According to various embodiments, retaining board 50 can have disposed therein one or more compressible stabilizing cushions 62. Each compressible stabilizing cushion 62 can comprise an elastically deformable material, for example, rubber, sponge, plastic, foam, or any other suitable elastically compressible material. Each compressible stabilizing cushion 62 can comprise an elastically deformable material. The elastically deformable material can be configured such that when a force is applied to compressible stabilizing cushion 62, compressible stabilizing cushion 62 can be deformed. When the pressure is removed from compressible stabilizing cushion 62, the elastically deformable material of the cushion can cause the cushion to recoil back to its original position.

According to various embodiments, compressible stabilizing cushion 62 can be spaced from operational surface 52 of retaining board 50 by a second distance 66. Second distance 66 can represent the distance between the retaining board and the most distal surface of compressible stabilizing cushion 62. Second distance 66 can be greater than first distance 64. In some embodiments, second distance 66 is the equivalent of first distance 64. In some embodiments, second distance 66, is less than first distance 64. As will be appreciated, when a plurality of compressible stabilizing cushions are held in or on a retaining board, they can each have an equal second distance, a different second distance, or a combination of both.

According to various embodiments, each compressible stabilizing cushion 62 can comprise any desired shape or size. Each compressible stabilizing cushion 62 can be, for example, rectangular, square, circular, trapezoidal, triangular, or a combination thereof, or of any other desired shape or size. In some embodiments, a plurality of compressible stabilizing cushions can be held on retaining board 50. When a plurality of compressible stabilizing cushions 62 are mounted to or secured by the retaining board, the compressible stabilizing cushions can be equal in shape, of similar but different shape, and/or of different shape. The compressible stabilizing cushions can be affixed to the retaining board by any conventional methods, for example, by glue, resin, epoxy, adhesive, or any other method of fastening. In some embodiments, compressible stabilizing cushion can comprise a locking device that allows the compressible stabilizing cushion to be locked into retaining board 50. Retaining board 50 can also comprise compressible stabilizing cushion slots or recesses for retaining one or more compressible stabilizing cushions 62.

According to various embodiments, retaining board 50 can have disposed therein one or more paper pushing devices. The most distal contact surface 34 of each paper pushing device can be spaced from retaining board 50 by a third distance 70. Third distance 70 can be greater than second distance 66, equal to second distance 66, or less than second distance 66. In some embodiments, a paper pushing device is used but the retaining board does not comprise a compressible stabilizing cushion 62. In some embodiments, a paper pushing device is used but the retaining board does not comprise a die rule 58. In some embodiments, a paper pushing device is used but the retaining board does not comprise a die lock 60.

According to various embodiments, a paper pushing device, a compressible stabilizing cushion, die rules, die slots, and/or any other desired components, can be arranged in or on the operational surface of a retaining board in any configuration desired. As will be appreciated by one skilled in the art, the configuration shown in FIG. 8 is only meant as an example, and does not limit the placement of components in or on the retaining board.

FIG. 9 shows a paper pushing device 90 according to yet another embodiment of the present teachings. As shown in FIG. 9, the paper pushing device can comprise a paddle that is approximately two to three times as wide as the head of paper pushing device 90. As will be appreciated, FIG. 9 is exemplary only, and is not meant to limit the scope of the present teachings. Relative to the device shown in FIGS. 1-6, paper pushing device 90 has a much wider paddle than paddle 34 of paper pushing device 8.

According to various embodiments, the paper board lifting device of the present teachings can be used in a stock manipulation method. The method can comprise processing a workpiece, for example, in at least one manipulation station. The at least one station can comprise at least one of a stripping station, a blanking station, an embossing station, a printing station, a combination thereof, or any other tool and die station. The method can comprise manipulating a stock to form a manipulated workpiece.

According to various embodiments, the method can comprise expelling a workpiece from the at least one station with a paper pushing device. The paper pushing device can comprise any of the features listed previously, for example, a shaft configured to be received in an opening of a retaining board, a head connected to the shaft, and an arm extending away from the head and comprising an intermediate section connected to the head, a paddle, and a diverging section having a narrow end and a wide end. As described above, the narrow end can be connected to the intermediate section and the wide end can be connected to the paddle. The expelling can comprise bending the paddle with an applied force and subsequently pushing the workpiece with the paddle. Other embodiments will be apparent to those skilled in the art from consideration of the present specification and practice of various embodiments disclosed herein. It is intended that the present specification and examples be considered as exemplary only.

What is claimed is:

1. A paper pushing device comprising:

a shaft configured to be received in an opening of a retaining board, the shaft comprising a longitudinal axis, a distal end, and a support end opposite the distal end;

a head comprising a planar top surface, a bottom surface that intersects with the support end of the shaft at an intersection, and a shoulder that begins at the intersection and extends outwardly away from the shaft, the shoulder providing the head with a bottom contact surface;

an arm extending from the head and away from the longitudinal axis, the arm comprising an intermediate section connected to the head, a diverging section having a narrow end and a wide end, and a paddle connected to the wide end of the diverging section, wherein the narrow end is connected to the intermediate section, the intermediate section has a first width, the paddle has a second width that is greater than the first width, and the diverging section has a width that increases from the first width to the second width in a direction from the narrow end to the wide end;

wherein the intermediate section extends from the head at an angle of from about 110° to about 160° relative to the longitudinal axis of the shaft, and the paddle is angled with respect to the intermediate section at an angle of from about 115° to about 165° relative to the intermediate section.

2. The paper pushing device of claim 1, wherein the shaft comprises a collar at the support end, the collar extends around the shaft and intersects with the bottom contact surface, the shaft has a minimum diameter, and the collar has an outer diameter that is greater than the minimum diameter.

3. The paper pushing device of claim 1, wherein the shaft comprises a plurality of annular sections spaced apart from one another, each annular section extending radially outwardly from the shaft and having an outer diameter that is greater than the minimum diameter.

4. The paper pushing device of claim 3, wherein the outer diameter of each annular section is greater than the outer diameter of the collar.

5. The paper pushing device of claim 1, wherein the intermediate section extends from the head at an angle of from about 130° to about 140° relative to the longitudinal axis of the shaft, and the paddle is angled with respect to the intermediate section at an angle of from about 135° to about 145°.

6. The paper pushing device of claim 1, wherein the paddle further comprises a top contact surface, and the top contact surface comprises a planar surface.

7. The paper pushing device of claim 6, wherein the planar surface of the top contact surface is substantially parallel to the planar top surface of the head.

8. A system comprising:

the paper pushing device of claim 1; and a retaining board comprising an operational surface and an opening disposed in the operational surface, the shaft of the paper pushing device is disposed in the opening.

9. The system of claim 8, wherein the retaining board has a thickness and the opening comprises at least one through hole that extends all the way through the thickness of the retaining board.

10. The system of claim 8, wherein the opening does not extend all the way through the retaining board such that the opening has a bottom surface.

11. The system of claim 8, wherein the retaining board further comprises one or more die rule slots disposed in the operational surface, wherein each die rule slot is configured to receive a die rule.

12. The system of claim 11, wherein the retaining board further comprises one or more die lock retaining slots disposed in the operational surface, wherein each die lock retaining slot intersects with one or more die rule slot and is configured to receive a die lock.

13. The system of claim 12, wherein the retaining board further comprises at least one die rule disposed in the one or more die rule slots, wherein the die rule comprises a distal edge and extends away from the retaining board such that the distal edge is disposed a first distance from the operational surface.

14. The system of claim 13, further comprising at least one die lock disposed in the one or more die lock retaining slots.

15. The system of claim 14, wherein the retaining board further comprises at least one compressible stabilizing cushion connected to the operational surface, wherein the compressible stabilizing cushion extends away from the retaining board, comprises a contact surface, and the contact surface of the compressible stabilizing cushion is spaced away from the operational surface by a second distance that is larger than the first distance.

16. The system of claim 15, wherein the contact surface of the paper pushing device is spaced away from the operational surface by a third distance is larger than the second distance.

* * * * *